US009527050B2

(12) United States Patent
Howell, Jr. et al.

(10) Patent No.: US 9,527,050 B2
(45) Date of Patent: Dec. 27, 2016

(54) ROTATIONALLY ACTUATED MAGNETIC BEAD TRAP AND MIXER

(75) Inventors: Peter B Howell, Jr., Gaithersburg, MD (US); Richard Eitel, Lexington, KY (US); Joel P Golden, Fort Washington, MD (US); Frances S Ligler, Potomac, MD (US)

(73) Assignee: The United States of America, as represented by the Secretary of the Navy, Arlington, VA (US)

( * ) Notice: Subject to any disclaimer, the term of this patent is extended or adjusted under 35 U.S.C. 154(b) by 1704 days.

(21) Appl. No.: 13/015,731

(22) Filed: Jan. 28, 2011

(65) Prior Publication Data

US 2011/0188339 A1 Aug. 4, 2011

Related U.S. Application Data

(60) Provisional application No. 61/299,587, filed on Jan. 29, 2010.

(51) Int. Cl.
*B01F 13/08* (2006.01)
*B01F 7/00* (2006.01)

(52) U.S. Cl.
CPC ..... *B01F 13/0818* (2013.01); *B01F 7/00908* (2013.01)

(58) Field of Classification Search
CPC ..... B01F 13/0818; B01F 7/00908
USPC ..... 366/273, 274; 210/222, 695
See application file for complete search history.

(56) References Cited

U.S. PATENT DOCUMENTS

| | | | | |
|---|---|---|---|---|
| 5,972,721 | A * | 10/1999 | Bruno et al. | 210/695 |
| 2002/0127740 | A1 | 9/2002 | Ho | |
| 2003/0012693 | A1 | 1/2003 | Otillar et al. | |
| 2003/0127396 | A1 | 7/2003 | Siddiqi | |
| 2005/0284817 | A1* | 12/2005 | Fernandez et al. | 210/695 |
| 2006/0001200 | A1* | 1/2006 | Takahashi | F27D 27/00 266/234 |
| 2006/0133194 | A1* | 6/2006 | Takahashi | B01F 5/102 366/147 |
| 2007/0105163 | A1 | 5/2007 | Grate et al. | |
| 2007/0292889 | A1 | 12/2007 | Bailey et al. | |
| 2008/0217254 | A1* | 9/2008 | Anderson | 210/695 |

OTHER PUBLICATIONS

Written Opinion of the International Searching Authority.
MagAttract 96 Miniprep Handbook, Qiagen, Dec. 2000.

(Continued)

*Primary Examiner* — Tony G Soohoo
*Assistant Examiner* — Anshu Bhatia
(74) *Attorney, Agent, or Firm* — US Naval Research Laboratory; Roy Roberts

(57) ABSTRACT

A magnetic bead trap-and-mixer includes a channel having openings at opposing ends, and a rotor adjacent to the channel and comprising a permanent magnet, wherein the rotor is adapted to apply a magnetic field to the channel of sufficient strength to direct the movement of magnetic beads therein. In aspects, the channel is straight and/or has narrowed end. In further aspects, the rotor generates in the channel areas of areas of strong magnetic fields alternating with areas of very weak magnetic fields and the strong magnetic fields extend entirely across the channel.

14 Claims, 7 Drawing Sheets

(56) References Cited

OTHER PUBLICATIONS

Lacharme, F., C. Vandevyver, et al. (2008). "Full on-chip nanoliter immunoassay by geometrical magnetic trapping of nanoparticle chains." Analytical Chemistry 80(8): 2905-2910.
Shikida, M., N. Nagao, et al. (2008). "A palmtop-sized rotary-drive-type biochemical analysis system by magnetic bead handling." Journal of Micromechanics and Microengineering 18(3).

* cited by examiner

A B C

ROTATIONALLY ACTUATED MAGNETIC BEAD TRAP AND MIXER

CROSS-REFERENCE TO RELATED APPLICATIONS

This Application claims the benefit of U.S. Provisional Application No. 61/299,587 filed on Jan. 29, 2010, the entirety of which is incorporated herein by reference.

BACKGROUND

Magnetic beads have become a popular means of performing affinity separations and bioprocessing reactions. The beads can be pulled from suspension by applying a permanent magnet to the side of a vessel containing them. Many of the current protocols are not automated and still require the manual addition of reagents, collection, and resuspension of the beads. Automation usually involves the use of large electromagnets, which can be placed at the side of a tube or capillary to collect the beads and subsequently turned off so to release the beads. However, the currents typically required preclude their use in battery powered devices. Added engineering is also typically needed to make sure the heat generated by the coils does not interfere with the chemistry of the beads. These prior designs also do not provide any mixing of the beads with the solution while they are trapped. Certain prior designs also cause undesired aggregation of magnetic beads and/or fail to release the beads concentrated into a reduced volume as desired.

A need exists for a mechanically simple means of capturing magnetic beads from a flowing stream, providing some degree of mixing with the passing fluid, and releasing the beads back into the stream while minimizing aggregation.

BRIEF SUMMARY

In one embodiment, a magnetic bead trap-and-mixer includes a straight channel having openings at opposing ends, and a rotor adjacent to the channel and comprising a permanent magnet, wherein the rotor is adapted to apply a magnetic field to the channel of sufficient strength to direct the movement of magnetic beads therein.

In one embodiment, a magnetic bead trap-and-mixer includes a channel having openings at opposing ends and a diameter that is narrower near the opposing ends than in a center of the channel, and a rotor adjacent to the channel and comprising a permanent magnet, wherein the rotor is adapted to apply a magnetic field to the channel of sufficient strength to direct the movement of magnetic beads therein In another embodiment, a magnetic bead trap-and-mixer includes a channel having openings at opposing ends, and a rotor adjacent to the channel and comprising a permanent magnet, wherein the rotor is adapted to apply a magnetic field to the channel of sufficient strength to direct the movement of magnetic beads therein, and the rotor generates in the channel areas of areas of strong magnetic fields alternating with areas of very weak magnetic fields and the strong magnetic fields extend entirely across the channel.

DETAILED DESCRIPTION

Definitions

Figure 1:
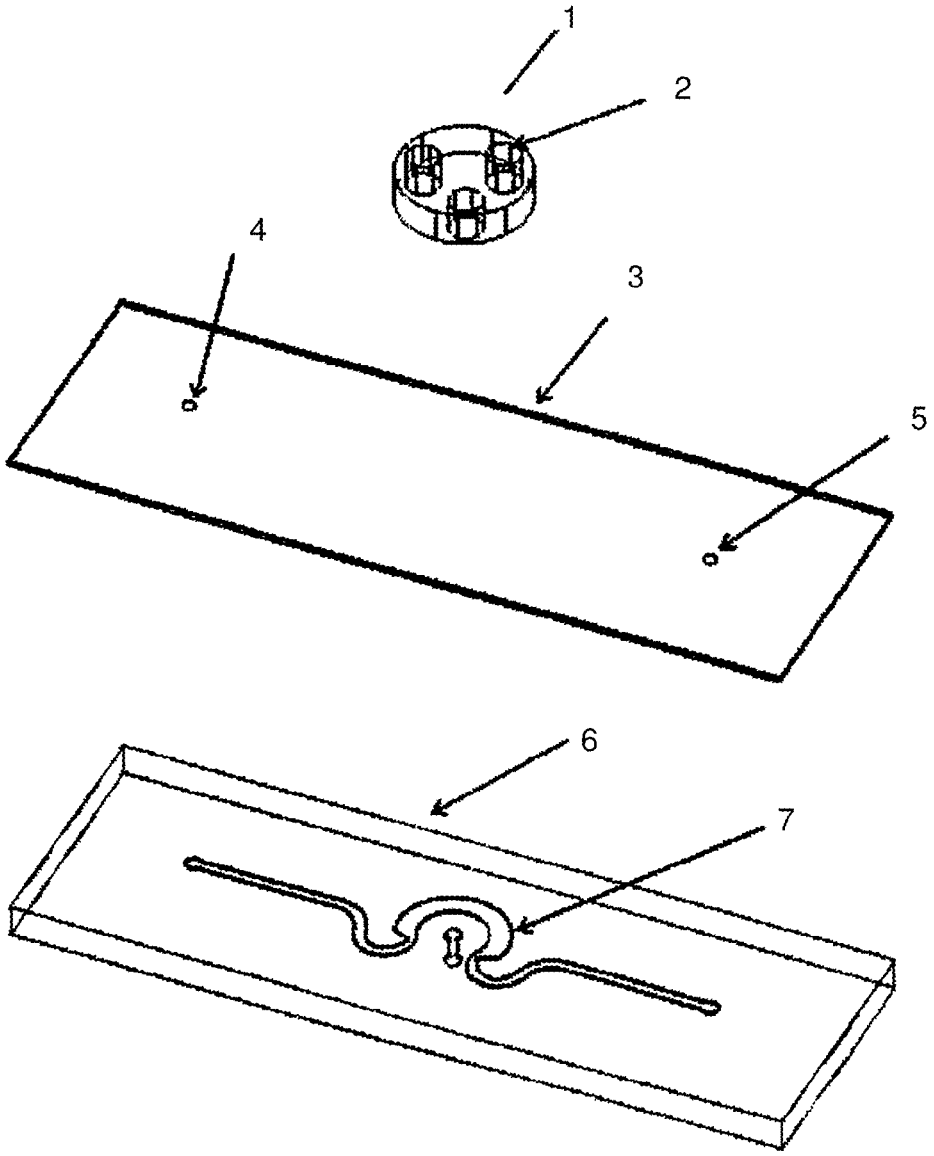
FIG. 1 shows an exemplary embodiment of a magnetic bead trap-and-mixer.

Before describing the present invention in detail, it is to be understood that the terminology used in the specification is for the purpose of describing particular embodiments, and is not necessarily intended to be limiting. Although many methods, structures and materials similar, modified, or equivalent to those described herein can be used in the practice of the present invention without undue experimentation, the preferred methods, structures and materials are described herein. In describing and claiming the present invention, the following terminology will be used in accordance with the definitions set out below.

As used in this specification and the appended claims, the singular forms "a," "an," and "the" do not preclude plural referents, unless the content clearly dictates otherwise.

As used herein, the term "and/or" includes any and all combinations of one or more of the associated listed items.

Description

The apparatus and method described herein aims to concentrate magnetic beads and expose them to one or more fluids with minimal bead aggregation. This is important both for maximizing the efficiency of different bead surface reactions and for the ability to interrogate individual beads in analytical equipment downstream from the device. The beads may be mixed with a sample to be analyzed or a reagent for processing prior to introduction into the trap or the beads may be suspended in a fluid within the trap prior to the addition of a sample or reagent. In the first case, the beads will be concentrated in the trap as the higher volume of sample or reagent passes through the channel. In the second case, the trap would retain the beads in a concentrated suspension as sample and/or reagents are passed through the channel. After the processing is complete, the concentrated beads are released into downstream analytical equipment including but not limited to flow cytometers, imaging devices, spectrometers, impedance meters, microarray analyzers, or electrochemical sensors. Alternatively, the released beads with any bound cells or molecules can be retained for cell culture or other further processing.

A rotor incorporating one or more permanent magnets rotates adjacent to a channel adapted to contain magnetic beads in a liquid. When the rotation results in a magnetic field passing across the channel generally in a direction opposite to flow of the liquid, the beads are effectively trapped and mixed in the liquid. By changing the direction of rotation, the beads can be released from the channel.

In one aspect, the rotor includes a single permanent magnet that wraps around the channel, for example with a horse-shoe shape. In other aspects, one or more magnets are included in the rotor.

The rotor can be placed so that the plane of rotation is parallel to the axis of the channel (or the plane of the channel if the channel is curved or arced), or it may be tilted, so that magnets are closest to the channel in a region where trapping is desired and move away from the channel where release is desired. The rotor may also be conical, and tilted so that the movement of the magnets toward and away from the plane of the channel is increased. A conical rotor may also be used in an untilted position, which means that the portion of the channel closest to the axis of rotation is also closest to the magnets. The tilt angle may be adjustable during use.

The movement of the beads is dictated by the shape of the field as well as by the motion of the magnets and the geometry of the channel. The channel created in a solid substrate may be made using any suitable technique, such as milling, molding, extrusion, and the like, and combinations of techniques. Such channels can be made in plastic, glass, silicon or other materials as long as the magnetic field can pass through one side of the channel. The channel can also be composed of tubing made of glass, metal, and/or plastic.

The dimensions of the channel can be designed to change the flow velocity in the different regions of the channel, and consequently to manipulate the ratio of flow shear to magnetic field strength. For example, a channel may have openings at opposing ends and a diameter that is narrower near the opposing ends than in a center of the channel in order to reduce the flow velocity between the ends of the channel. Reducing the flow velocity can also be used to extend the time that the beads are in contact with different reagents for sample processing at a constant flow rate and/or to reduce the sheer forces on the beads. The bead trap-and-mixer is operable with straight as well as curved channels. If retention of a constant angle during the sweep is desired, a horseshoe-shaped channel can be used. Straight channels can have advantages for moving beads across the channel or for simplification of manufacture or integration into more complex systems.

FIG. 1 illustrates an exemplary embodiment of a magnetic bead trap-and-mixer. A rotor 1 includes three permanent magnets 2. A top plate 6 and a bottom plate 6 define the sides of a channel 7. The top plate includes an inlet 4 and outlet 5 for the channel 7.

Figure 2:
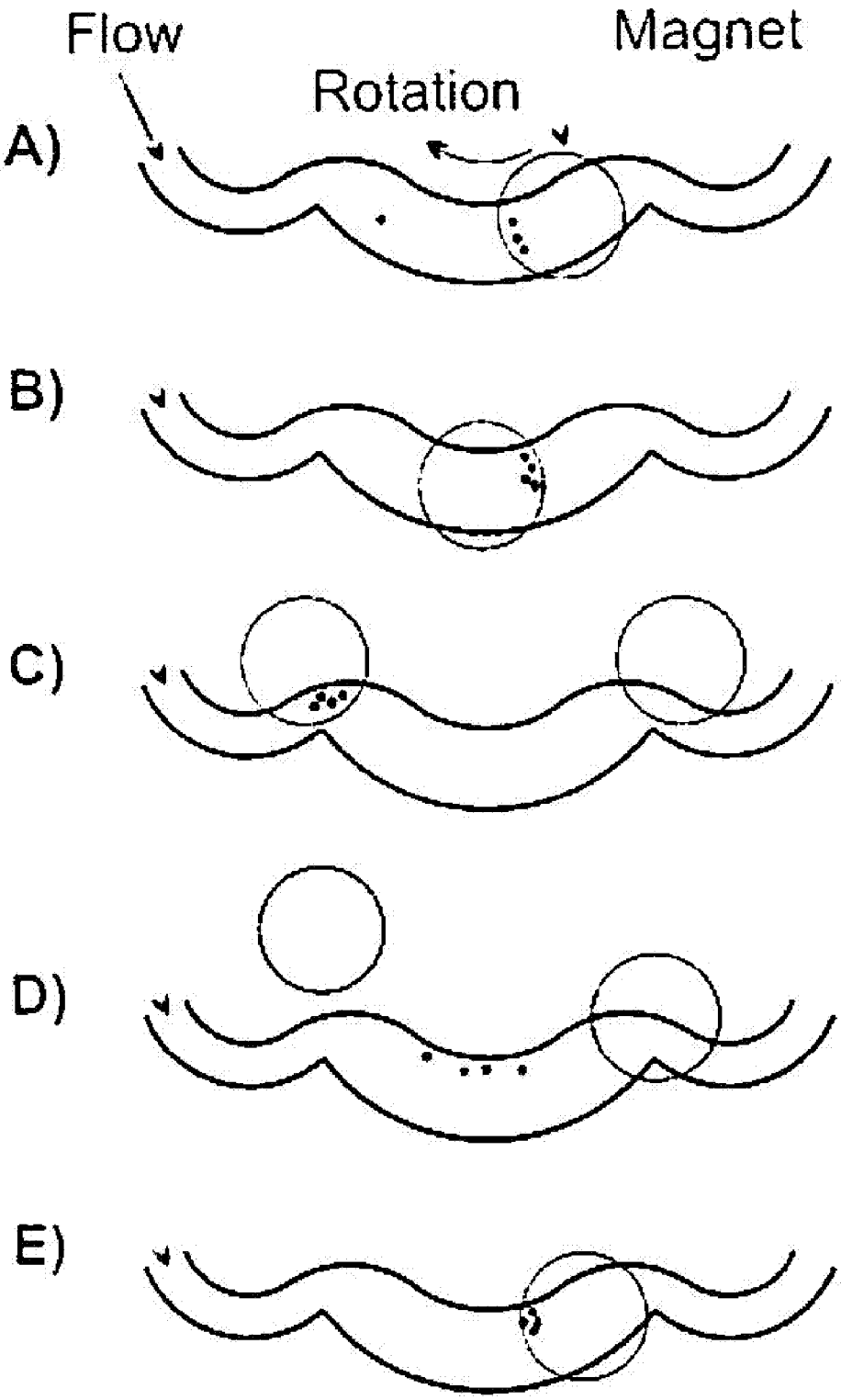
FIG. 2 shows the "catch and release" mixing of magnetic beads.
Figure 3:
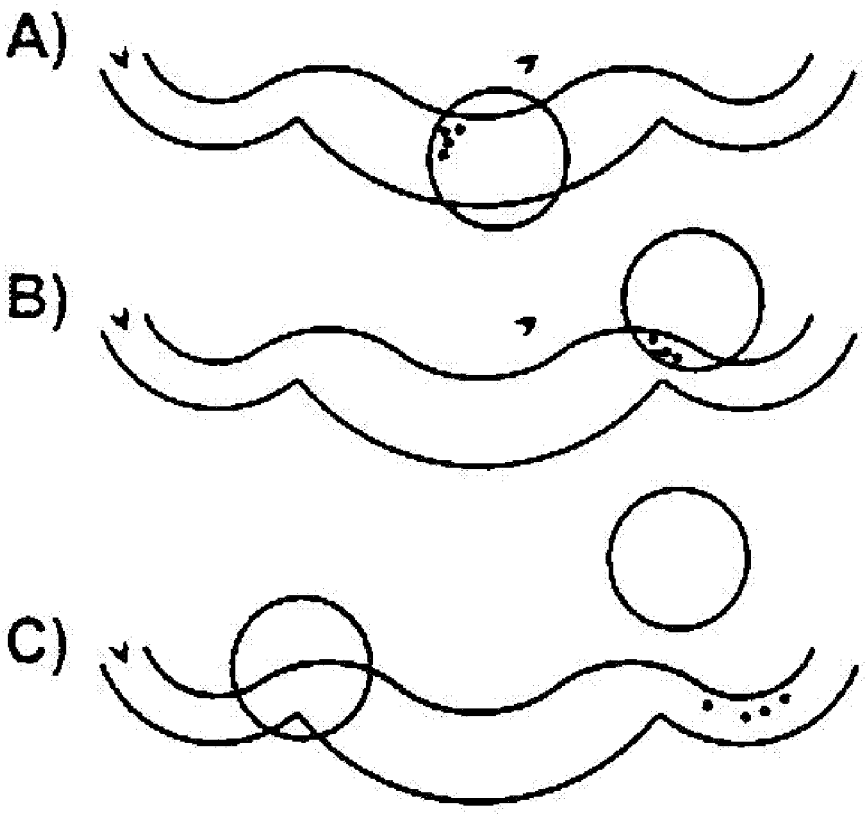
FIG. 3 shows the release of magnetic beads.

FIG. 2 shows the "catch and release" mixing of magnetic beads. In (a), beads flow through the chamber and become trapped by the magnetic field. In (b), the field created by a first magnet captures the beads, and drags them upstream as the rotor rotates. During capture, the magnet is rotated so that the magnetic field moves against the direction of flow. In (c), the beads are swept upstream by the magnetic field until reaching the upstream end or the channel, where the rotation of the first magnet moves the field away from the channel. The spinning rotor brings a second magnet into position at the right side of the drawing. In (d), the beads have been temporarily released and travel with fluid flow through an area of low magnetic field between the magnets. In (e), the beads are captured by the field created by a second magnet, and the cycle can begin again. This operation has been performed with individual magnets as shown in the figure. It can also be performed using more than one magnet at each position in order to increase the field strengths extending into the channel. Magnets can have similar or different field strengths and/or any suitable dimensions FIG. 3 shows the release of magnetic beads, accomplished by reversing the direction of rotation of the rotor as compared to FIG. 2. In (a), the magnet begins to move towards the outlet at the downstream end of the channel, and the magnetic field concentrates the beads in the stream as they flow toward the downstream end of the channel. In (b), the magnetic field sweeps the beads to the downstream end of the chamber and the area of high magnetic field begins to be moved away from the channel. In (c), the beads are released and free to flow out of the chamber for any downstream processing and/or analysis.

Figure 4:
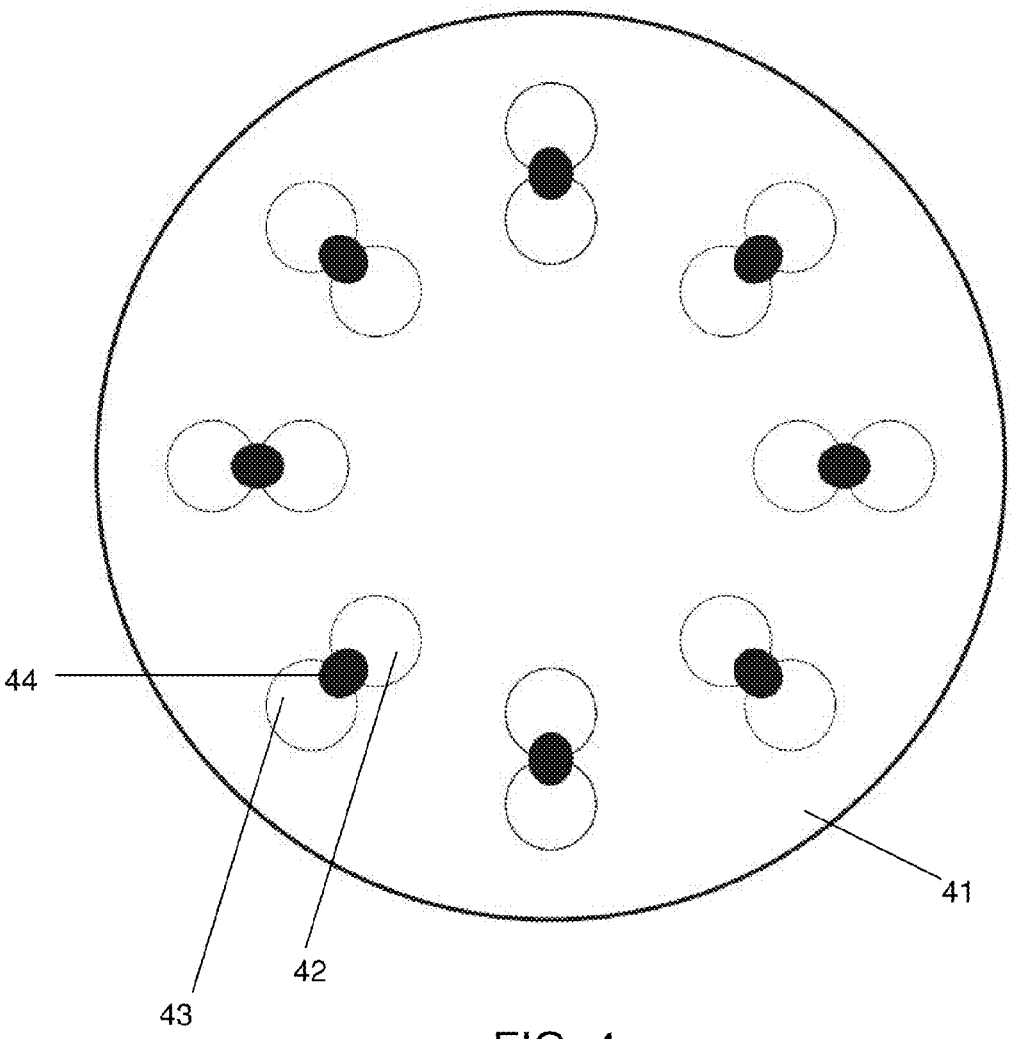
FIG. 4 shows the magnetic fields resulting from a rotor wherein the magnetic poles are arranged to focus the magnetic fields to a point.

Anderson, U.S. Patent Application Publication No. 2008/0217254, discloses a rotary magnetic bead trap which is connected to a mass spectrometry system. Anderson's device requires pairs of magnets with opposing magnetic poles in contact with each other, thereby creating a magnetic field gradient focused on a single point between N/S (north/south) magnet pairs. Because of the point-shaped magnetic field, Anderson's tube or lumen must be positioned in a circular path over the rotating magnet carrier so that the magnetic trapping regions are positioned in the center of the channel. FIG. 4 shows the magnetic fields resulting from the arrangement of pairs of magnets 42 and 43 embedded in a rotor 41 touching each other at a single point and with their magnetic poles in opposite directions. This organization of the magnets focuses the highest strength of the magnetic field to a point 44. As a result of this design, the only way to move the beads from side to side in the channel is to create a serpentine channel deviating slightly from "the ideal circular profile followed by the magnetic trap regions." An additional aspect of these concentrated point-shaped trapping regions is that they collect the magnetic beads into clumps that are moved periodically upstream. Since the used beads are sent to waste or collected solely for later use, the resulting aggregation is not perceived as a problem in Anderson. In contrast, aspects of the apparatus described herein generate a magnetic field extending entirely across the diameter of the channel, thus reducing the aggregation of beads that is undesirable in many applications. The shape of the channels in the current invention is not limited by the need to accommodate a circular arrangement of point-shaped magnetic traps. Anderson also requires a curved tube, whereas the present apparatus operates effectively with a straight channel, and moreover Anderson fails to appreciate the advantages provided by channels having particular contours, such as narrower ends.

Figure 5:
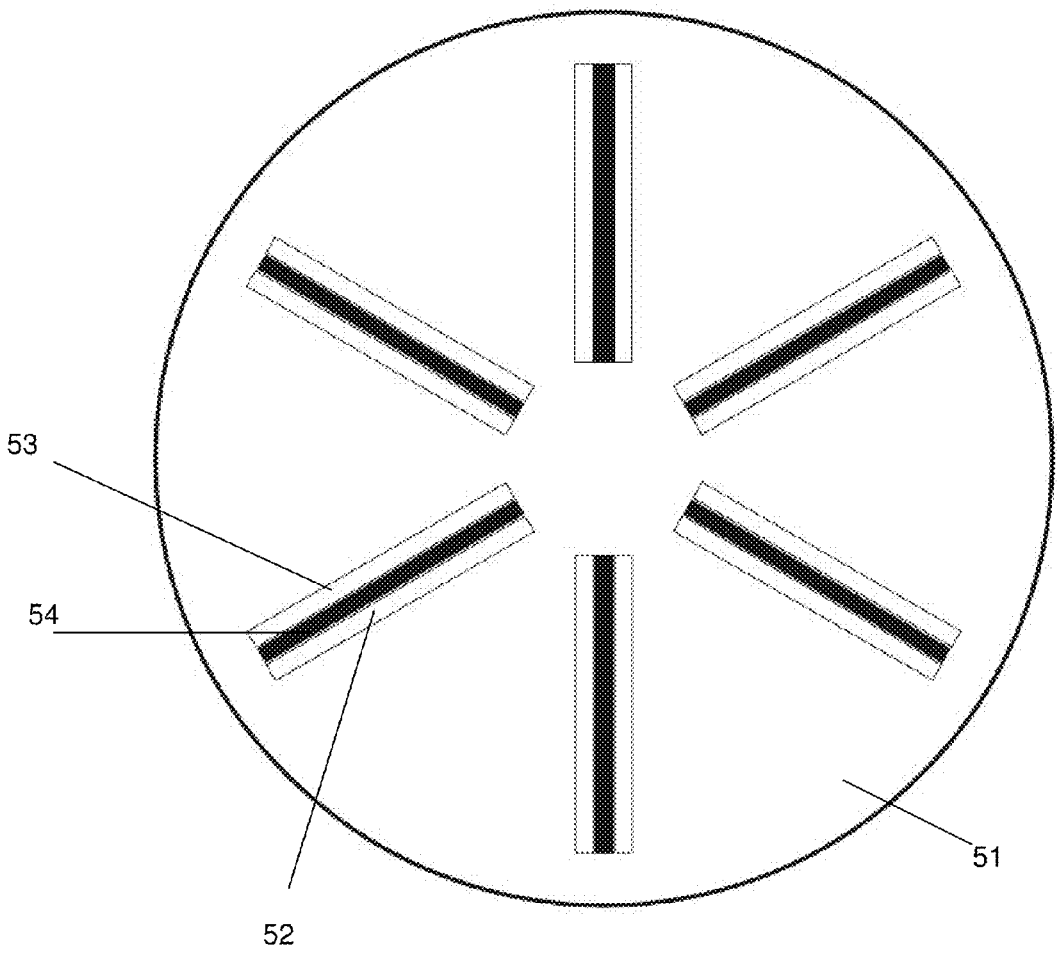
FIG. 5 shows the magnetic fields in an embodiment having magnets arranged in an alternating configuration.

FIG. 5 shows the magnetic fields 54 in an embodiment having magnets 52 and 53 arranged in a rotor 51 such that a magnetic field 54 is created that is long enough to extend across the flow channel. It is not necessary that the magnets be in contact with one another. The magnets can be arranged with poles in the same or opposite directions as long as the magnetic field at areas of high magnetic field extend far enough into the channel to capture the magnetic beads under flow conditions and the areas between the magnets generate sufficiently low magnetic field in the channel to allow release of the magnetic beads.

Figure 6:
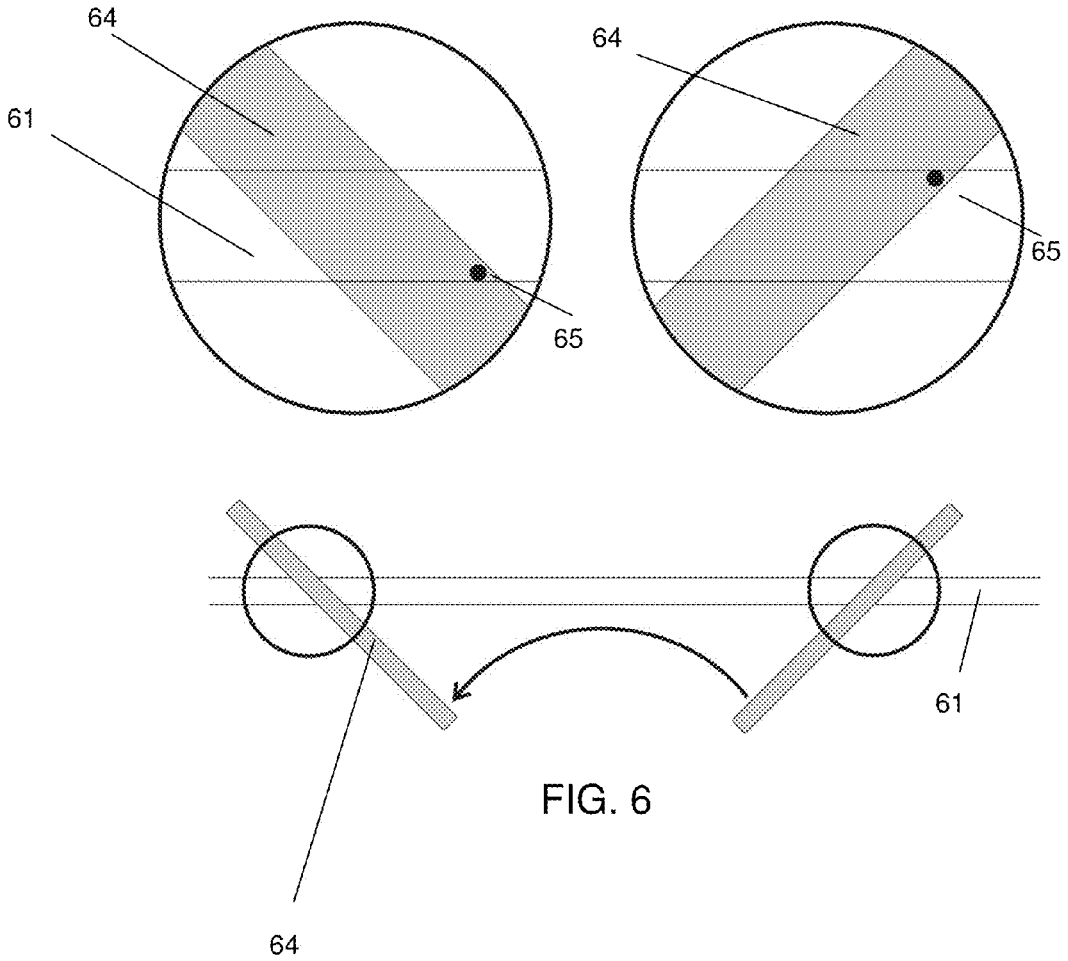
FIG. 6 shows how a linear magnetic field may be used to move the beads across a channel as well as longitudinally upstream or downstream.

FIG. 6 shows how a linear magnetic field may be used to move the beads across a channel as well as longitudinally upstream or downstream, thus enhancing the exposure to the fluid in the channel. The magnetic field 64 is shown here with a straight channel 61 and a single bead 65. The flow is from left to right in the stream and the field is moved from right to left. Initially, the magnetic field tends to push the bead toward the side of the channel further from the center of the magnet rotation, but as the rotation continues, the bead is dragged toward the opposite side of the channel.

EXAMPLE 1

Comparison of capture of fluorescent magnetic beads using different configurations of linear magnetic fields, termed configuration A where the poles all point in the same direction (e.g. N/N, N/N, N/N, N/N), configuration B with poles pointed in an alternating configuration (e.g. N/S, S/N, N/S, S/N), and configuration C with opposite pairs of poles paired (e.g. N/S, N/S, N/S, N/S).

Figure 7:
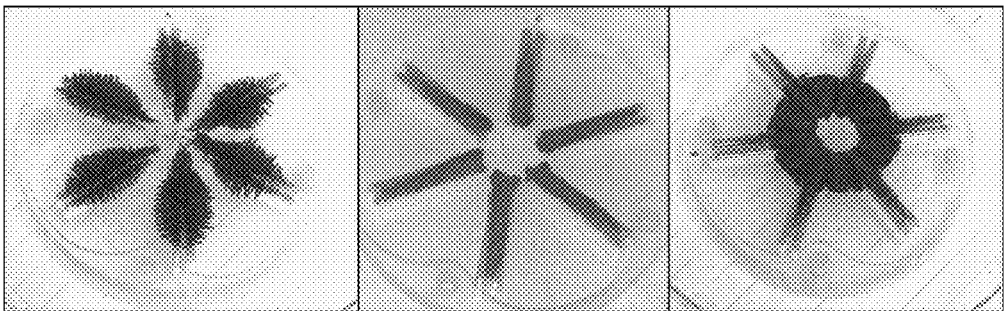
FIG. 7 contains images wherein magnetic filings are used to visualize the magnetic fields of magnets arranged in various configurations.

In order to visualize the magnetic fields induced by the different arrangements of the magnets, the linear magnets affixed in the rotating trap were removed from under the microfluidic channel and placed under a clear dish containing iron filings and photographed, with FIG. 7A showing configuration A, FIG. 7B showing configuration B, and FIG. 7C showing configuration C. The photographs suggest that configuration A produced a field that extends further into the microchannel to improve the capture while maintaining regions of low field to permit release when the field is swept in the same direction as the flow. The photo of configuration B suggests that the field required for capture does not extend as far, but that the low field regions necessary for release are maintained. The photo of configuration C suggests that a microchannel placed over a region with sufficient field for capture would not experience a magnetic field sufficiently low for release at any time.

The configurations were tested to effectiveness in trapping and releasing magnetic beads. Linear magnetic fields were created for sweeping through the fluid passing through a microchannel. The ability of the fields to capture 6.5 micron fluorescent magnetic beads against the direction of flow and retain them was measured, along with the number of the beads released when the direction of the magnet rotation was reversed or when the magnet was removed altogether. Ideally, the beads would be retained during the capture phase as the magnetic field was swept upstream and released as the magnetic field was swept downstream, without the necessity to physically remove the magnets.

Figure 8:
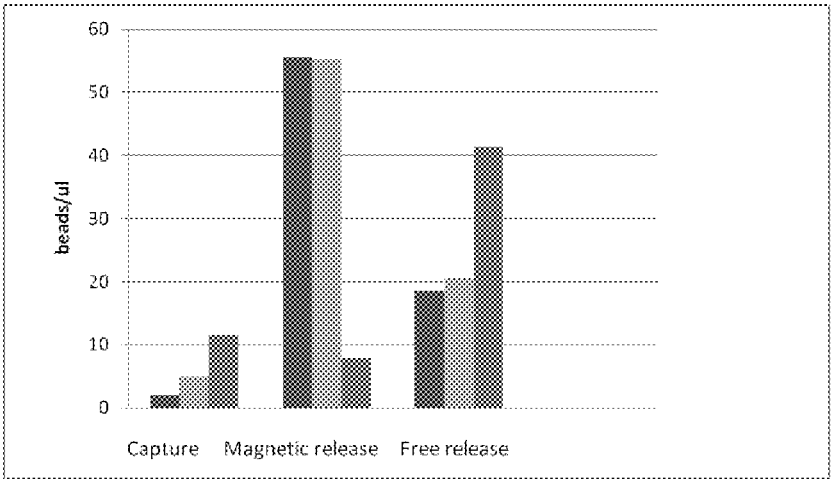
FIG. 8 shows bead capture results for magnets in various configurations.

Capture takes place when the magnets are positioned in a rotating disc immediately below the microchannel and are rotating in the direction opposite of the flow through the channel. Magnetic release is the stage where magnetic beads previously captured by the magnets are released by reversing the direction of magnet rotation. Free release is the flow of beads through the microchannel after the magnetic field is removed. FIG. 8 shows the results collected: dark gray bars depict data using the magnets positioned all in the same direction (configuration A), light gray bars indicate data using magnets in pairs with opposite poles (configuration B), and the medium gray bars depict data using magnets in configuration C.

The best results were achieved with the "same" configuration, where all the magnets are oriented with the poles in the same direction (N/N, N/N, N/N, N/N). As is seen in the graph, the concentration of beads/μL exiting the channel was reduced during capture and increased dramatically during magnet-assisted release. Capture of beads continued for ~20 minutes with a 11 μl/min flow rate.

The second best result was achieved using with the "alternating" configuration, where the adjacent magnets in a pair had opposite pole orientations, and neighboring pairs were minor images of each other (N/S, S/N, N/S, S/N). While the capture was not as efficient as in the first configuration, a dramatic release of beads did occur when the direction of the sweeping magnetic field was reversed. Capture of beads occurred for ~10 minutes at a 11 μl/min flow rate.

In the third configuration, "opposite", the magnets were arranged so that every magnet has a pole orientation opposite of its two neighbors (N/S, N/S, N/S, N/S). While the beads were captured, they were not released when the rotation of the magnets was reversed. However, there was a dramatic release of beads when the magnets were pulled completely out of range of the channel, indicating that the beads were captured, but the magnets did not allow them to escape the channel during the period of reversed rotation of the magnets. Capture of beads occurred for ~12-15 minutes at a 11 μl/min flow rate.

The apparatus described herein enjoys several advantages over prior art devices. The simple design and use of permanent magnets permit operation by battery power, for example in a portable device. No significant heat is generated, unlike electromagnetics, so that heat sinks are not required and the possibility of degradation of the sample is reduced. The actuation of the trap by use of a reversible motor avoids the need for specialized armatures and/or plumbing. The design has little or no dead volume, without requiring deep alcoves. Furthermore, the design results in excellent mixing, in that the repeated "catch and release" cycle allows the beads to spend a period of time free so that their full surfaces can be in full contact with the solution. In addition, during their migration upstream, they are being pulled against the solution flow, increasing the portion of the solution that they come in contact with compared to beads held in one spot in a channel.

All publications mentioned herein are hereby incorporated by reference for the purpose of disclosing and describing the particular materials and methodologies for which the reference was cited.

Although the present invention has been described in connection with preferred embodiments thereof, it will be appreciated by those skilled in the art that additions, deletions, modifications, and substitutions not specifically described may be made without departing from the spirit and scope of the invention. Terminology used herein should not be construed as being "means-plus-function" language unless the term "means" is expressly used in association therewith.

What is claimed is:

1. A magnetic bead trap-and-mixer comprising:

a straight channel having openings at opposing ends, and a rotor adjacent to the channel and comprising a permanent magnet, wherein the rotor is adapted to apply a magnetic field to the channel of sufficient strength to direct the movement of magnetic beads therein, wherein the magnetic field extends entirely across the channel, and wherein said movement is both across the channel and longitudinally upstream or downstream wherein the rotor has a plane of rotation that is tilted or adjustable with respect to an axis of the channel, and wherein said rotor comprises magnets positioned in a rotating disc.

2. The magnetic bead trap-and-mixer of claim 1, wherein the rotor is configured so that areas of strong magnetic fields alternate with areas of very weak magnetic fields.

3. The magnetic bead trap-and-mixer of claim 1, wherein the rotor comprises at least two permanent magnets.

4. The magnetic bead trap-and-mixer of claim 3, wherein the at least two magnets have magnetic poles all oriented in the same direction with respect to the channel.

5. The magnetic bead trap-and-mixer of claim 1, wherein the permanent magnet is a single magnet that wraps around the channel.

6. The magnetic bead trap-and-mixer of claim 1, wherein the channel has a diameter that is narrower near the opposing ends than in a center of the channel.

7. A magnetic bead trap-and-mixer comprising:

a channel having openings at opposing ends and a diameter that is narrower near the opposing ends than in a center of the channel, and a rotor adjacent to the channel and comprising a permanent magnet, wherein the rotor is adapted to apply a magnetic field to the channel of sufficient strength to direct the movement of magnetic beads therein, wherein the magnetic field extends entirely across the channel, and wherein said movement is both across the channel and longitudinally upstream or downstream.

8. The magnetic bead trap-and-mixer of claim 7, wherein the rotor is configured so that areas of strong magnetic fields alternate with areas of very weak magnetic fields.

9. The magnetic bead trap-and-mixer of claim 7, wherein the rotor is configured so that said magnetic field that extends entirely across the channel.

10. The magnetic bead trap-and-mixer of claim 7, wherein the rotor comprises at least two permanent magnets.

11. The magnetic bead trap-and-mixer of claim 10, wherein the at least two magnets have magnetic poles all oriented in the same direction with respect to the channel.

12. The magnetic bead trap-and-mixer of claim 7, wherein the permanent magnet is a single magnet that wraps around the channel.

13. A magnetic bead trap-and-mixer comprising:

a channel having openings at opposing ends, and a rotor adjacent to the channel and comprising a permanent magnet, wherein the rotor is adapted to apply a magnetic field to the channel of sufficient strength to direct the movement of magnetic beads therein, such movement being is both across the channel and longitudinally upstream or downstream, wherein the magnetic field extends entirely across the channel, and wherein the rotor has a plane of rotation that is tilted or adjustable with respect to an axis or plane of the channel.

14. The magnetic bead trap-and-mixer of claim 7, wherein the channel is straight.

* * * * *